United States Patent [19]

Atherton

[11] 3,976,871

[45] Aug. 24, 1976

[54] HANDBAG WITH MEANS FOR ILLUMINATING THE INTERIOR THEREOF

[76] Inventor: Ira W. Atherton, 508 Broadway, East Alton, Ill. 62024

[22] Filed: Apr. 29, 1975

[21] Appl. No.: 572,855

[52] U.S. Cl. ..... 240/6.45 P
[51] Int. Cl.[2] ..... A45C 15/06
[58] Field of Search ..... 240/6.45 R, 6.45 P

[56] References Cited

UNITED STATES PATENTS

| | | | |
|---|---|---|---|
| 2,540,470 | 2/1951 | Baugh | 240/6.45 P |
| 2,629,045 | 2/1953 | Frohlich | 240/6.45 P X |
| 2,647,201 | 7/1953 | Contento | 240/6.45 P |
| 2,779,344 | 1/1957 | Hemmings | 240/6.45 R X |
| 3,609,342 | 9/1971 | Wisniewski | 240/6.45 P |
| 3,792,652 | 2/1974 | Zeeb | 240/6.45 P |

FOREIGN PATENTS OR APPLICATIONS

| | | | |
|---|---|---|---|
| 132,122 | 4/1949 | Australia | 240/6.45 P |

*Primary Examiner*—Donald F. Norton
*Attorney, Agent, or Firm*—Gravely, Lieder & Woodruff

[57] ABSTRACT

A handbag has a frame to which a flexible pouch is attached, and this frame is hinged so that it can be opened to provide access to the interior of the pouch. The frame further contains a battery, a bulb, and a switch in the circuit between the battery and the bulb. The bulb when energized illuminates the interior of the pouch.

4 Claims, 4 Drawing Figures

HANDBAG WITH MEANS FOR ILLUMINATING THE INTERIOR THEREOF

BACKGROUND OF THE INVENTION

This invention relates in general to handbags, and more particularly to a handbag having means to illuminate the interior thereof.

Women carry a wide variety of items in their handbags, and under conditions of reduced visibility it is difficult to locate a particular item which may be needed at the time. For example, a women may have difficulty locating automobile or house keys at night.

SUMMARY OF THE INVENTION

One of the principal objects of the present invention is to provide a handbag having a lighting device which illuminates the interior thereof. Another object is to provide a handbag of the type stated in which the batteries of the lighting device are contained within the frame of the bag and do not occupy the interior of the bag or detract from the carrying capacity thereof. A further object is to provide a handbag of the type stated in which the lighting device is energized only when needed so as to conserve the batteries thereof. An additional object is to provide a handbag of the type stated in which the electrical circuitry of the lighting device is located remote from the interior of the bag so that items carried within the bag will not interfere with that circuitry. Still another object is to provide a handbag of the type stated which is simple in construction and easy to manufacture. These and other objects and advantages will become apparent hereinafter.

The present invention is embodied in a handbag having a frame and a flexible pouch attached to the frame. The frame carries means for illuminating the interior of the pouch. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
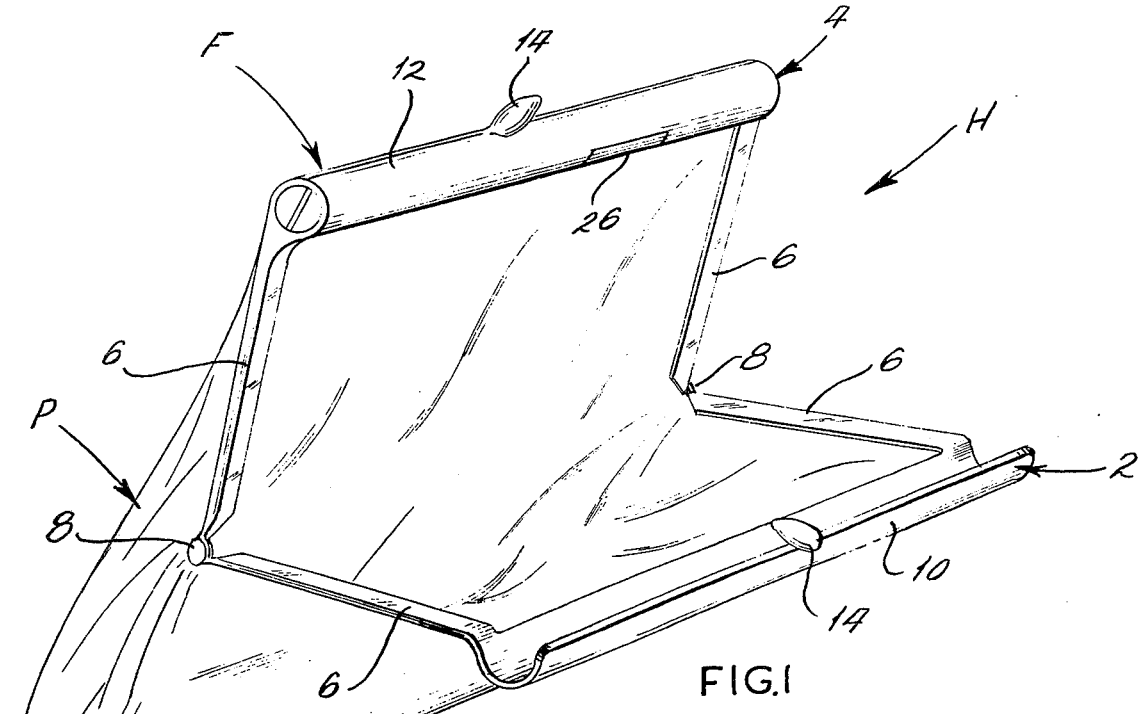
FIG. 1 is a perspective view of the handbag of the present invention.

Referring now to the drawings (FIG. 1), H designates a handbag which basically consists of a frame F and a flexible pouch D attached to the frame F. The pouch P may be made from leather, vinyl, or fabric, and has its lower end permanently closed. The frame F moves between open and closed positions and since the upper end of the pouch P is attached to the frame F, that end of the pouch P moves with the frame F.

Figure 2:
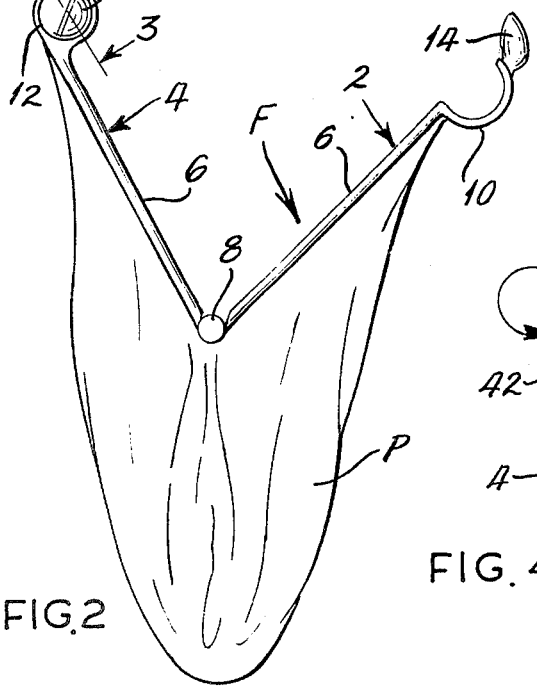
FIG. 2 is an end view of the handbag in its open position.

The frame F includes (FIGS. 1 and 2) a pair of generally U-shaped frame sections 2 and 4, each of which has parallel side members 6 with the side members of the section 2 being connected at their lower ends to the lower ends of the corresponding side members 6 on the section 4 by hinge pins 8. The upper ends of the two side members 6 on the section 2 are attached to a longitudinal top piece 10, while the upper ends of the side members 6 on the section 4 are attached to a longitudinal top piece 12. The two top pieces 10 and 12 are the same length, but the top piece 12 is round or cylindrical in cross-sectional configuration, whereas the top 10 is generally arcuate, with its concave face presented toward the top piece 12. Indeed, the curvature of that concave face conforms to the curvature of the exterior surface on the top piece 12. Secured to the midportion of the top piece 10 is a latch tab 14 which engages another latch tab 14 on the top piece 12 when the frame sections 2 and 4 are together so as to hold the frame F in its closed position. The latch tab 14 may be detached from the top piece 12 so that the frame sections 2 and 4 may be moved apart to the open position for the frame F. This exposes the interior of the pouch P and enables items to be inserted or removed from the pouch P.

Figure 3:
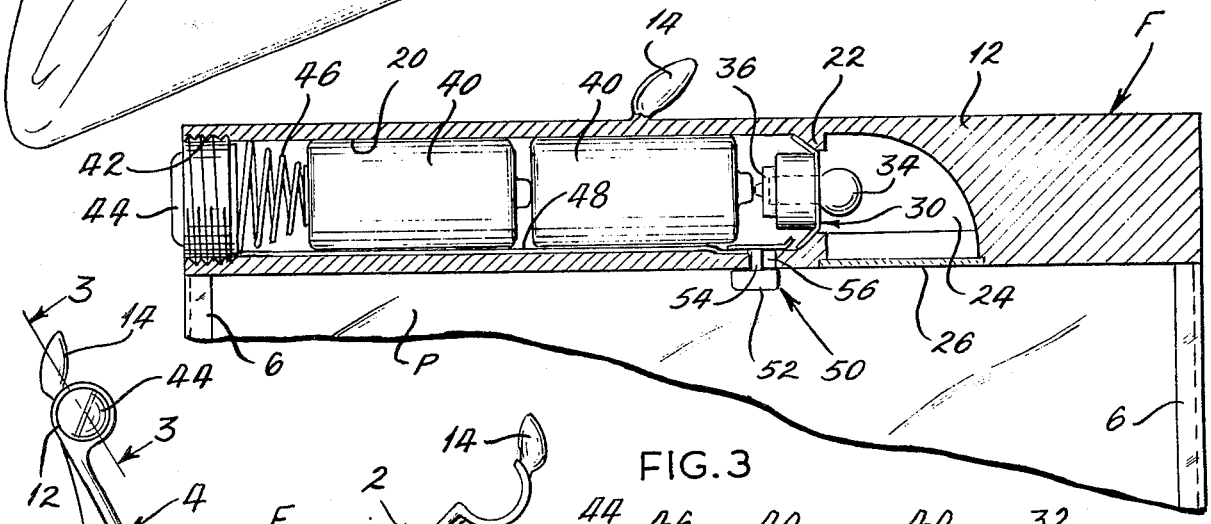
FIG. 3 is a longitudinal sectional view of the frame section containing the illuminating means.
Figure 4:
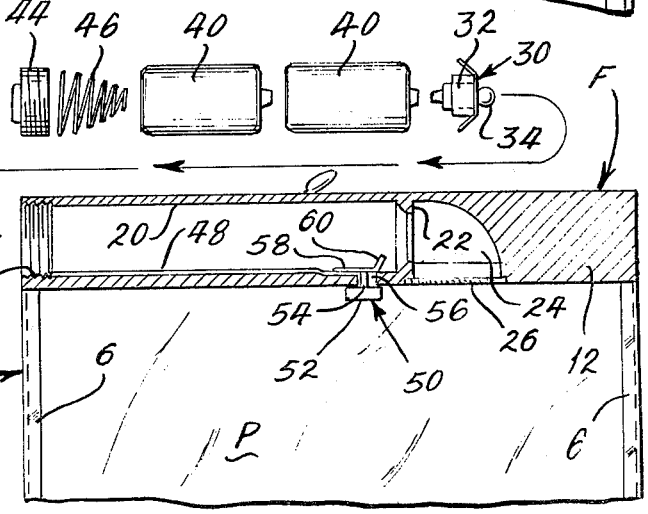
FIG. 4 is an exploded sectional view of the illuminating means.

The longitudinal top piece 12 of the frame section 4 has a battery cavity (FIGS. 3 and 4) in the form of a bore 20 which extends inwardly from one end thereof and terminates at a beveled shoulder 22. The bore 20 opens into a bulb cavity 24 at the shoulder 22, and this cavity is likewise disposed entirely within the top piece 12. The surface of the cavity 24 is curved to a somewhat concave configuration and is coated with a reflective material. The bulb cavity 24 is located intermediate the ends of the top piece 12 and opens downwardly into the interior of the pouch P. This end of the cavity 24 is closed by a transparent or translucent window 26 which is flush with the surface of the top piece 12.

Housed within the inner end of the bore 20 is a bulb carrier 30 having a tapered forward surface which fits against the beveled shoulder 22 and indeed is located thereby. The bulb carrier 30 is made of metal and has a bulb socket 32 which receives a bayonet type bulb 34 and also a bushing 36 which retains the bulb 32 in the socket 32. Actually, only the base of the bulb 34 is within the socket 32 and the center contact thereon is exposed rearwardly through the bushing 36. The filament of the bulb 34 and the glass globe which encloses it project forwardly through the bulb carrier 30 and into the bulb cavity 24. Thus, when the bulb 34 is energized, the light emitted by the filament will be both directed downwardly and reflected downwardly through the window 26. The metal bulb carrier 30 is in electrical contact with the cylindrical base of the bulb 34.

The major portion of the bore 20 is occupied by two batteries 40 (FIG. 3) arranged in a series in the usual manner. The center terminal on the leading battery bears against the center contact on the base of the bulb 34. The outer end of the bore 20 is provided with threads 42 which are engaged by threads on an end plug 44 which screws into and closes the end of the bore 20. The end plug 44 carries a metal coil spring 46 which is compressed against the end of the rear battery 40. This spring forces the center terminal on the lead battery 40 against the center contact on the bulb 34 and forces the center terminal on the rear battery 40 tightly against the rear end of the lead battery 40.

Extending along the bottom of the bore 20 at the sides of the batteries 40 is an elongated conductor 48. The one end of this conductor contacts the spring 46 near the threads 42. The opposite end overlies a switch 50.

The switch 50 includes (FIG. 3) a button 52 which lies along the underside of the top piece 12 and hence is exposed within the interior of the pouch P. The button 52 serves as the actuating element for the switch 50 and is connected to a stem 54 which projects through a slot 56 in the top piece 12. This slot 56 opens into the forward end of the bore 20, and its major axis extends in the direction of the axis of the bore 20. Within the bore 20, the stem 54 is attached to a metal tab 58 which underlies and contacts the inner end of the conductor 48 and has a lip 60 which is presented toward the metal ring 38 on the bulb carrier 30.

When the switch button 52 is moved toward the window 26, it will bring the lip 60 of the tab 58 against the metal ring 38 on the bulb carrier 30. This will complete an electrical circuit through the batteries 40 and bulb 34. That circuit traces as follows: from the center terminal of the leading battery 40, through the center contact, filament, and cylindrical base of the bulb 34, thence to the metal bulb carrier 30 to the tab 58 which contacts it, thereafter through the elongated conductor 48 to the spring 46 and the rearmost battery 40. In other words, when the switch 50 is toward the window 26, the filament of the bulb 34 is placed across the two series connected batteries 40 and is illuminated. The light emitted by the filament passes through the window 26 and into the interior of the pouch P, illuminating the same.

When the switch button 52 is moved away from the window 26, the circuit through the filament is broken at the tab 58 so the light is no longer projected into the pouch P.

In use, the user opens the handbag H by merely spreading two frame sections 2 and 4 apart at their respective top pieces 10 and 12. If there is not enough external illumination to illuminate the interior of the pouch P, the user merely moves the switch 50 to its closed position so that the bulb 34 will provide the illumination necessary to see items within the pouch P.

Since the batteries 40, bulb 34 and associated components are all housed in the frame F, they do not detract from the usable volume of the pouch p. Furthermore, the user upon reaching into the pouch P cannot disturb or disrupt the circuitry.

This invention is intended to cover all changes and modifications of the example of the invention herein chosen for purposes of the disclosure which do not constitute departures from the spirit and scope of the invention.

What is claimed is:

1. A handbag comprising: a pouch having a hollow interior; a frame attached to the pouch such that the pouch depends from the frame, the frame having first and second sections which move relative to each other between open and closed positions and are provided with generally parallel longitudinal top pieces, the top pieces being in juxtaposition when the frame is closed and being spread apart when the frame is open so as to expose the interior of the pouch and provide access thereto, the top piece on the first frame section having a battery cavity therein and a bulb cavity located beyond the end of the battery cavity, the bulb cavity being directed downwardly toward the interior of the pouch, the top piece of the first frame section further having a beveled shoulder which separates the battery cavity from the bulb cavity with the bevel thereon being presented toward the battery cavity; means for holding the top pieces of the two frame sections together to maintain the frames in the closed position, but to enable the frames to move to their open position; a bulb carrier within the battery cavity and having a beveled surface which fits against the beveled surface of the shoulder so that the beveled surface of the shoulder locates the bulb carrier within the batter cavity; a bulb supported in the bulb carrier such that the bulb projects into the bulb cavity; at least one battery in the battery cavity; a light transmitting element mounted on the top piece of the first frame section flush with the downwardly presented surface of that frame section, the light transmitting element being extended across the bulb cavity in the top piece of the first frame section such that the bulb is separated from the interior of the pouch by the light transmitting element, whereby the light transmitting element protects the bulb from objects within the pouch; and switch means on the top piece of the first frame section for placing the bulb in circuit with the battery when actuated, the switch means including a manually operated actuating element which is located on the top piece of the first frame section and projects therefrom in the same direction as the bulb cavity is directed, whereby the switch means may only be operated when the frame is in its open position.

2. A handbag according to claim 1 wherein the battery cavity is a bore which opens out of one side of the first frame section; and wherein a plug normally closes the bore to retain the battery therein.

3. A handbag accordng to claim 1 wherein the bulb has a longitudinal axis and is mounted at the end of the bore with its longitudinal axis colinear with the axis of the bore.

4. A handbag according to claim 1 wherein the battery cavity is a bore, one end of which opens out of the end of the top portion for the first frame section and the other end of which opens into the bulb cavity; and wherein a bulb carrier is located in the bore where it opens into the bulb cavity and holds the bulb, and closure means for closing the end of the bore which opens out of the frame section so as to retain the battery therein.

* * * * *